US005507875A

United States Patent [19]

Hailey

[11] Patent Number: 5,507,875

[45] Date of Patent: Apr. 16, 1996

[54] METHOD FOR CLEANING CONCRETE DELIVERY TRUCKS

[76] Inventor: Jeff Hailey, 15463 Wood Forest, Channelview, Tex. 77530

[21] Appl. No.: 282,302

[22] Filed: Jul. 29, 1994

[51] Int. Cl.[6] ..... B08B 3/12; B08B 7/02

[52] U.S. Cl. ..... 134/1; 134/16; 134/22.1; 134/23; 134/32; 134/33

[58] Field of Search ..... 134/1, 8, 16, 22.1, 134/22.11, 23, 32, 33

[56] References Cited

U.S. PATENT DOCUMENTS

| | | | |
|---|---|---|---|
| 3,577,349 | 5/1971 | Haines | 252/170 |
| 3,981,624 | 9/1976 | Brandon | 417/53 |
| 4,120,699 | 10/1978 | Kennedy, Jr. et al. | 134/1 |
| 4,528,040 | 7/1985 | Vickery | 134/8 |
| 4,585,355 | 4/1986 | Waitzinger | 366/55 |
| 4,682,912 | 7/1987 | Henry | 405/154 |
| 4,893,361 | 1/1990 | Burns | 4/255 |

*Primary Examiner*—Jan H. Silbaugh
*Assistant Examiner*—Robin S. Gray
*Attorney, Agent, or Firm*—Norman B. Rainer

[57] ABSTRACT

Hardened concrete is removed from the drum of a concrete-transporting truck by applying strong vibrational force to the exterior of the drum. Apparatus for applying the vibration includes a vibration impact device suspended from the end of a laterally oriented holding arm. The opposite end of the holding arm is pivotably attached to a vertical post. A control arm, pivotably attached to the post has a hydraulic cylinder adapted to cause raising or lowering of the suspended impact device.

3 Claims, 2 Drawing Sheets

METHOD FOR CLEANING CONCRETE DELIVERY TRUCKS

BACKGROUND OF THE INVENTION

1. Field of the Invention

This invention concerns a cleaning method and apparatus, and more particularly relates to the removal of residual concrete from the interior of the drum of a concrete delivery truck.

2. Description of the Prior Art

Concrete delivery trucks generally have a rotating drum into which freshly made concrete is placed at the concrete production facility. During the course of travel to the delivery site, the drum is continuously rotated to assure the uniformity of the concrete mixture.

At the place of use, the concrete is dumped through a sluice trough into the exact location requiring the concrete. Although the entire load of concrete is dumped, there is always some concrete that clings to the interior walls of the drum. The most generally employed expedient for removing the clinging concrete is to direct a strong spray of water from a hose into the interior of the rotating drum. Unless done with care and thoroughness, the water stream may not achieve a complete cleaning. There are also situations where a hose for supplying running water is not available at the dump site. In such instances, the truck must return to the concrete plant before cleaning can commence.

By this time, however, the concrete has began to harden to a non-water dispersible state, and even a powerful stream of water is insufficient to remove the hardened concrete from the wall of the drum.

Numerous prior aft techniques have been disclosed for removing hardened concrete from the interior surface of the drum. Such techniques generally employ high force streams of water, chemical additives, abrasive treatments, rotation with heavy stones or balls, and the use of small jackhammers. Such techniques, however, have been found to be ineffective, time consuming, expensive, or deleterious to the drum. Most such techniques are confronted with the difficulty of working through the narrow opening of the drum which limits tool size and movement options, and further causes difficulty in reaching the innermost recesses of the drum.

The cleaning of concrete delivery drums is furthermore a hazardous chore. For example, eye injuries, lung damage, loss of hearing and allergic reactions have been commonplace. There is also the possibility that a worker may unknowingly be inside the drum while rotation is initiated during a cleaning operation.

Accordingly, it is an object of the present invention to remove dried concrete adhered to the interior wall of a concrete drum.

It is another object of the present invention to provide a method, as in the foregoing object, which does not require entrance into the drum opening.

It is a further object of the present invention to provide a cleaning method of the aforesaid nature which is rapidly accomplished and does not require a source of running water.

It is yet another object of this invention to provide apparatus for achieving the aforesaid cleaning method and which is non-damaging to the concrete drum.

It is a still further object of this invention to provide apparatus of the aforesaid nature which is fast-acting and of simple, rugged construction amenable to low cost manufacture.

These and other beneficial objects and advantages will be apparent from the following description.

SUMMARY OF THE INVENTION

The above and other beneficial objects and advantages are accomplished in accordance with the present invention by a method for removing hardened concrete from the interior wall surface of a truck-mounted rotatable concrete drum by applying to the exterior surface of said drum vibratory energy of controlled intensity. Apparatus for providing said vibratory treatment, representing another aspect of the present invention, is comprised of a vertically upright support post, a laterally directed holding arm having a rear extremity pivotably held by said post and a forward extremity which pendently secures a vibration-producing device. A control arm of adjustable length has a proximal extremity pivotably associated with said post and a distal extremity that pivotably joins said holding arm, The control arm is preferably comprised of a cylinder interactive with a reciprocating piston and activated by pressurized pneumatic or hydraulic fluid.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
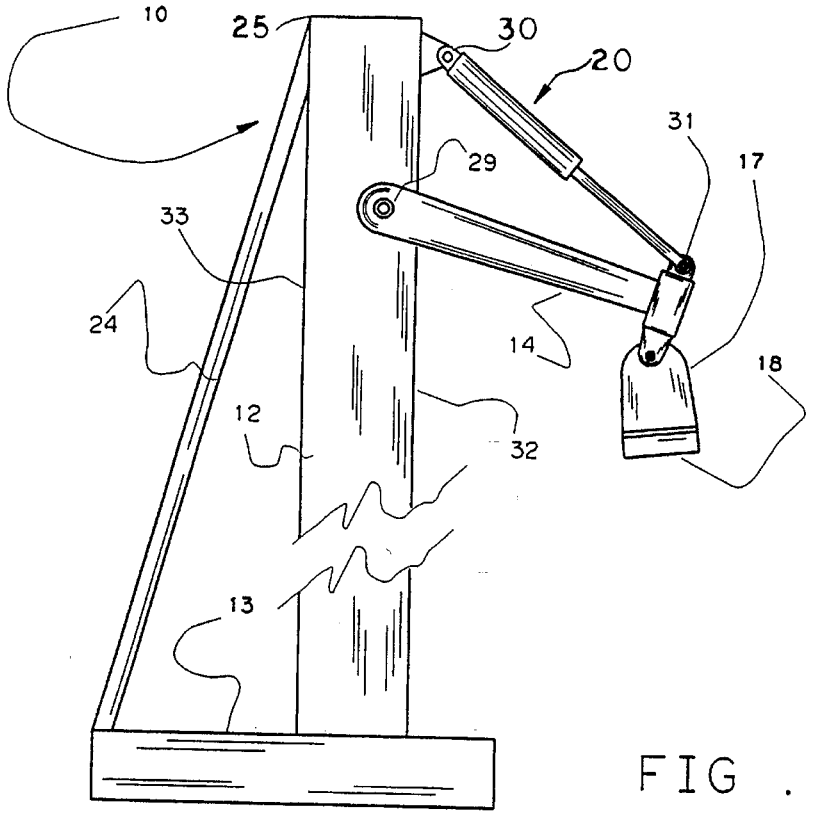
FIG. 1 is a side view of an embodiment of the apparatus of this invention.
Figure 2:
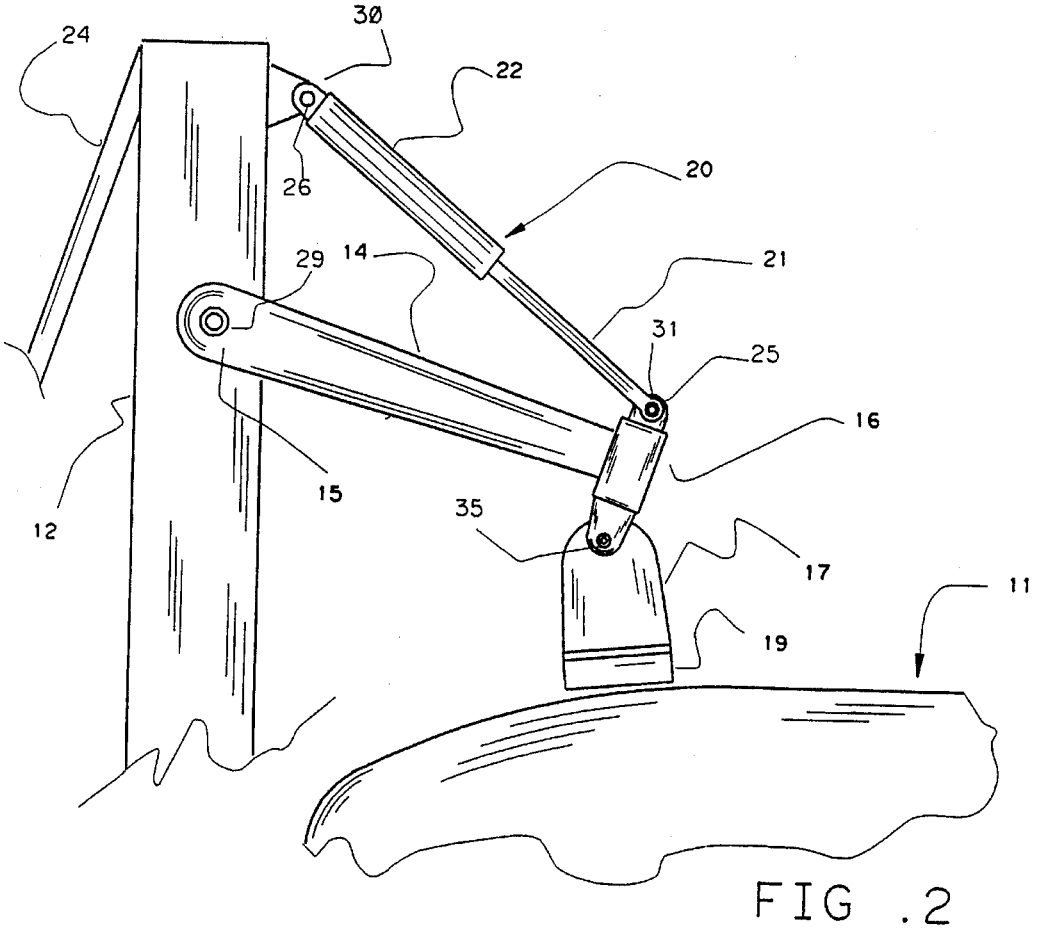
FIG. 2 is a Fragmentary side view of the embodiment of FIG. 1 shown in operative association with the drum of a concrete-carrying truck.

Referring to FIGS. 1–5, an embodiment of the cleaning apparatus 10 of the present invention is shown in functional association with the rotating drum 11 of a concrete truck. The cleaning apparatus is comprised of vertically upright support post 12 which is securely anchored to the ground, preferably by way of a concrete casement foundation 13. Post 12, having front and rear side surfaces, 32 and 33, respectively, is preferably fabricated of structural steel, having a lateral cross-sectional configuration of about 8 to 10 inches in square or H-beam configuration, and a height of 15–20 feet. Diagonal support struts 24 may extend between foundation 13 and the rear upper extremity 25 of post 12.

A laterally directed holding arm 14 is pivotably attached at its rear extremity 15 to said post 12. Said attachment is by way of first pivot means in the form of bearing rod 29. The forward extremity 16 of arm 14 pendently secures a vibration-producing device 17. The length of arm 14, measured between said rear and forward extremities is between about 8 and 12 feet, and is shorter than the distance measured upwardly on post 12 from the site of attachment of arm 14.

The vibration-producing device 17 has a flat lower surface 18 which is covered with a resilient protective layer 19 to prevent denting damage to the concrete drum. Device 17 may be energized by electricity or pneumatics, and is intended to delivery hammer-like blows having a force of 10–40 pounds at a frequency of 2–20 blows/second. The force and frequency of the blows may be controlled by adjustments of the energizing source.

Figure 5:
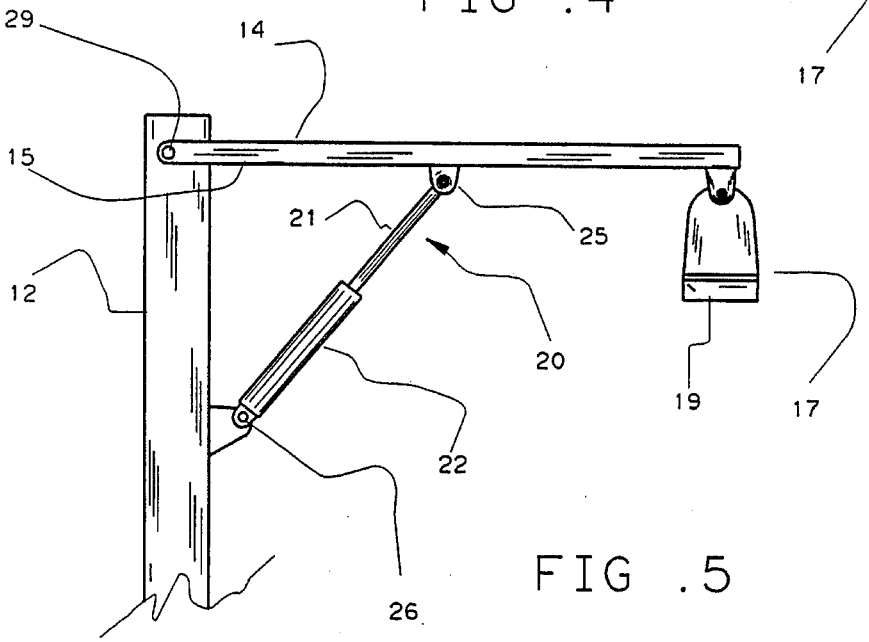
FIG. 5 is a fragmentary side view of a second alternative embodiment of the apparatus.

A control arm 20, elongated between proximal and distal extremities 30 and 31, respectively, is attached at its distal extremity to forward extremity 16 of holding arm 14. Said attachment is by way of second pivot means in the form of bearing rod 25. The proximal extremity 30 of said control arm attaches to post 12 by way of third pivot means in the form of bearing rod 26. Said control arm is disposed substantially as the hypotenuse of a triangle whose other sides include post 12 and holding arm 14. Control arm 20 is comprised of a piston portion 21 and cylinder portion 22. By controlling pneumatic or hydraulic pressure within the cylinder portion, the piston portion can be brought closer to or pushed further from the cylinder portion. Such action has the effect of raising or lowering, respectively, the vibration-producing device In the embodiment of FIG. 4, control arm 20 is pendently supported by fixed overhead beam 27 which attaches to the top of post 12. In the embodiment of FIG. 5, control arm 20 is disposed below holding arm 20.

Figure 3:
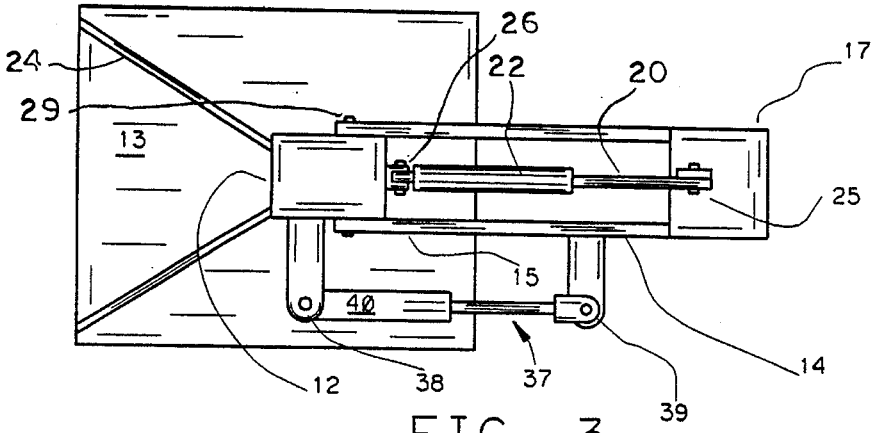
FIG. 3 is a top view of the embodiment of FIG. 1 with the addition of a lateral drive component.
Figure 4:
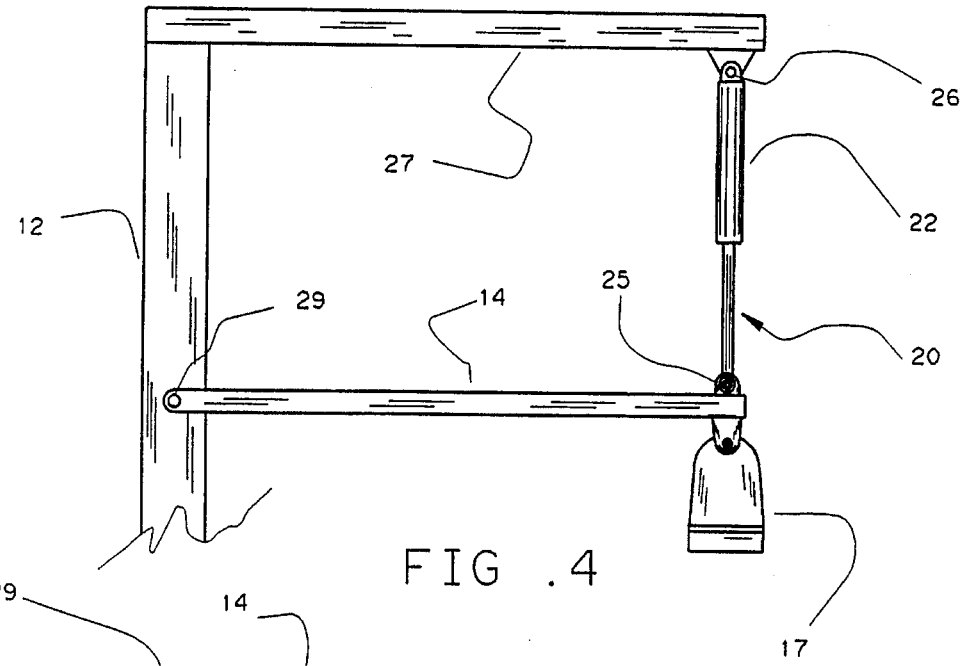
FIG. 4 is a fragmentary side view of a first alternative embodiment of the apparatus of this invention.

It is important to note that, in the several exemplified embodiments of the apparatus, there are three sites of pivoted mating, namely at both extremities of control arm 20, and at rear extremity 15 of holding arm 14. Said three pivot sites are preferably designed to have sufficient slack or omnidirectional movement as to enable the vibration-producing device 17 to be swung laterally back and forth so as to reach different portions of the concrete drum. A lateral drive arm 37, shown in FIG. 3, is joined by pivot hinge 38 to post 12 and by pivot hinge 39 to holding arm 14. Hydraulic cylinder 40 activates drive arm 37 so as to achieve swinging movement of the vibration producing device 17.

In the practice of the method of this invention, a cement-carrying truck having a rotatable drum is driven to a position below the vibration-producing device 17. The device 17 is lowered to make contact with the top exterior of the stationary drum. The vibration-producing device is energized, causing hardened concrete to chip away from the interior wall of the drum. The drum is sequentially rotated 45 degrees, and the vibration treatment is repeated. When all the exterior surface of the drum has been treated by the vibrator, the flakes and chips of concrete are removed by rotating the drum in the opposite direction from that used during delivery. The discharge of debris from the drum may be augmented by a stream of water, long-handled hoes, or vacuum techniques.

In a further preferred aspect of the apparatus of this invention, vibration-producing device 17 is attached by way of fourth pivot means in the form of bearing rod 35 to the forward extremity 16 of holding arm 14. Such manner of attachment enables lower surface 18 of device 17 to better conform to the surface contour of the concrete drum.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A process for removing hardened concrete from an interior wall surface of a truck-mounted concrete drum defined by said interior wall surface and an exterior wall surface and rotatable so as to cause said interior and exterior wail surfaces to pass through an upwardly directed top position, said process comprising applying to said exterior wall surface of said drum at said top position vibratory energy having a frequency of 2 blows per second to 20 blows per second, and a force between 10 pounds and 40 pounds, said vibratory energy being applied by a vibration-producing device pendently secured to an adjustable laterally directed holding arm in a manner permitting said device to contact said exterior wall surface at said top position.

2. The process of claim 1 wherein said drum is stationary during the application of said vibratory energy, and is rotated to different positions and stopped to permit application of said energy at several different sites on said external wall surface about a perimeter of said drum.

3. The process of claim 2 wherein said vibration-producing device has a resilient protective layer to prevent denting damage to said drum.

* * * * *